US010988953B2

(12) United States Patent
Underkofler et al.

(10) Patent No.: US 10,988,953 B2
(45) Date of Patent: Apr. 27, 2021

(54) BUILDING PERIMETER SYSTEM

(71) Applicant: USG Interiors, LLC, Chicago, IL (US)

(72) Inventors: Abraham M. Underkofler, Salem, WI (US); Peder J. Gulbrandsen, Aurora, IL (US); Mark R. Paulsen, Waukegan, IL (US); Michael P. O'Donnell, Modesto, CA (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 16/545,183

(22) Filed: Aug. 20, 2019

(65) Prior Publication Data

US 2021/0054643 A1 Feb. 25, 2021

(51) Int. Cl.
*E04B 1/98* (2006.01)
*E04H 9/02* (2006.01)

(52) U.S. Cl.
CPC ..... *E04H 9/021* (2013.01); *E04H 9/024* (2013.01)

(58) Field of Classification Search
None
See application file for complete search history.

(56) References Cited

U.S. PATENT DOCUMENTS 6,213,679 B1 * 4/2001 Frobosilo ..... E04B 2/82 403/403
7,293,393 B2 11/2007 Kelly et al.
8,615,948 B2 12/2013 Underkofler et al.
8,820,026 B2 9/2014 Underkofler et al.
9,476,194 B1 10/2016 Hulka et al.
10,036,163 B1 7/2018 Paulsen
10,407,905 B2 9/2019 Neal
2011/0283634 A1 * 11/2011 Underkofler ..... E04B 9/127 52/167.1
2012/0042584 A1 * 2/2012 Sareyka ..... E04B 9/30 52/167.1
2013/0205689 A1 * 8/2013 Lillette ..... E04B 9/06 52/167.1
2016/0153189 A1 * 6/2016 Wright ..... E04B 1/98 52/167.1
2018/0202157 A1 7/2018 Neal
2019/0330845 A1 10/2019 Neal

FOREIGN PATENT DOCUMENTS

CA 1234959 A 4/1988
DE 10 2013 014081 B3 12/2014
EP 0 409 029 A1 1/1991
IT RA20 110 003 A 7/2012

OTHER PUBLICATIONS

International Search Report and Written Opinion, International Application No. PCT/US2020/046174, filed Aug. 13, 2020, dated Oct. 19, 2020.

* cited by examiner

*Primary Examiner* — Basil S Katcheves
(74) *Attorney, Agent, or Firm* — Pearne & Gordon LLP

(57) ABSTRACT

A perimeter pocket system with an inner wall having a brace connecting protuberance and an extended ceiling supporting ledge with grid tee end reference marks or coupling structure for an extension. Grid tee connector clips have cam slots for raising grid tees in a seismic event and features imparting rigidity and vibration resistance.

3 Claims, 3 Drawing Sheets

BUILDING PERIMETER SYSTEM

BACKGROUND OF THE INVENTION

The invention relates to a suspended ceiling perimeter pocket system, some features of which can be used in seismic applications.

PRIOR ART

Perimeter pockets in ceiling construction are used to house shades and other devices above a ceiling plane making them less conspicuous and thereby improving the aesthetics of a room or enclosed spaced. These pockets can be constructed altogether on site or more often in recent times can be supplied by a building products manufacturer with custom hardware. Examples of the latter are disclosed in U.S. Pat. No. 10,407,905, issued from U.S. Ser. No. 15/317,744 (Publication No. US 2018/0202157A1, for example.

There is a need for premanufactured building perimeter pocket systems and related hardware that are satisfactory for service in seismic areas. Additionally, there is a need for premanufactured pocket systems that can be readily modified in height to suit a particular installation and that include features that facilitate installation.

SUMMARY OF THE INVENTION

The invention provides a perimeter pocket system particularly suited for use in seismic zones. The system includes an inner pocket wall having adjacent a lower edge an extended ceiling panel supporting ledge and a receiving channel for grid tee connector clips. Seismic connector clips of the invention have an extended grid tee supporting leg including a cam for raising an associated tee when the tee is displaced in a seismic event. The seismic clip is attached to the pocket leg in a vibration-resistant manner without fasteners, and has a geometry highly resistant to deflection of its grid tee support leg in a vertical plane thereby assuring that the grid tee remains above the pocket leg ledge in a seismic event.

The disclosed pocket ledge facilitates ceiling grid installation by providing reference marks indicating where grid tee runner ends are to be positioned to satisfy certain seismic building code requirements. Additionally, the inner pocket leg or wall preferably includes a protuberance, for example, in the form of a right angle flange that affords a convenient attachment zone for bracing elements, stiffens the pocket leg, and distributes bracing forces along the length of the pocket leg. The brace receiving protuberance is especially beneficial in seismic applications because the inner pocket leg, which supports an edge of a suspended ceiling is not directly mounted against a wall where it would be supported to withstand horizontal forces imposed by the ceiling during a seismic event.

Another feature of the invention involves an inner leg or wall extension which can be inventoried and ordered from a range of heights. The disclosed extension has a unique coupling structure with a compatible perimeter pocket inner leg. The coupling structure serves to immediately self-stabilize the vertical position of the extension making it easier for the installer to complete the erection of the perimeter pocket thereby saving time and reducing the risk of assembly mistakes.

DESCRIPTION OF THE PREFERRED EMBODIMENT

Figure 1:
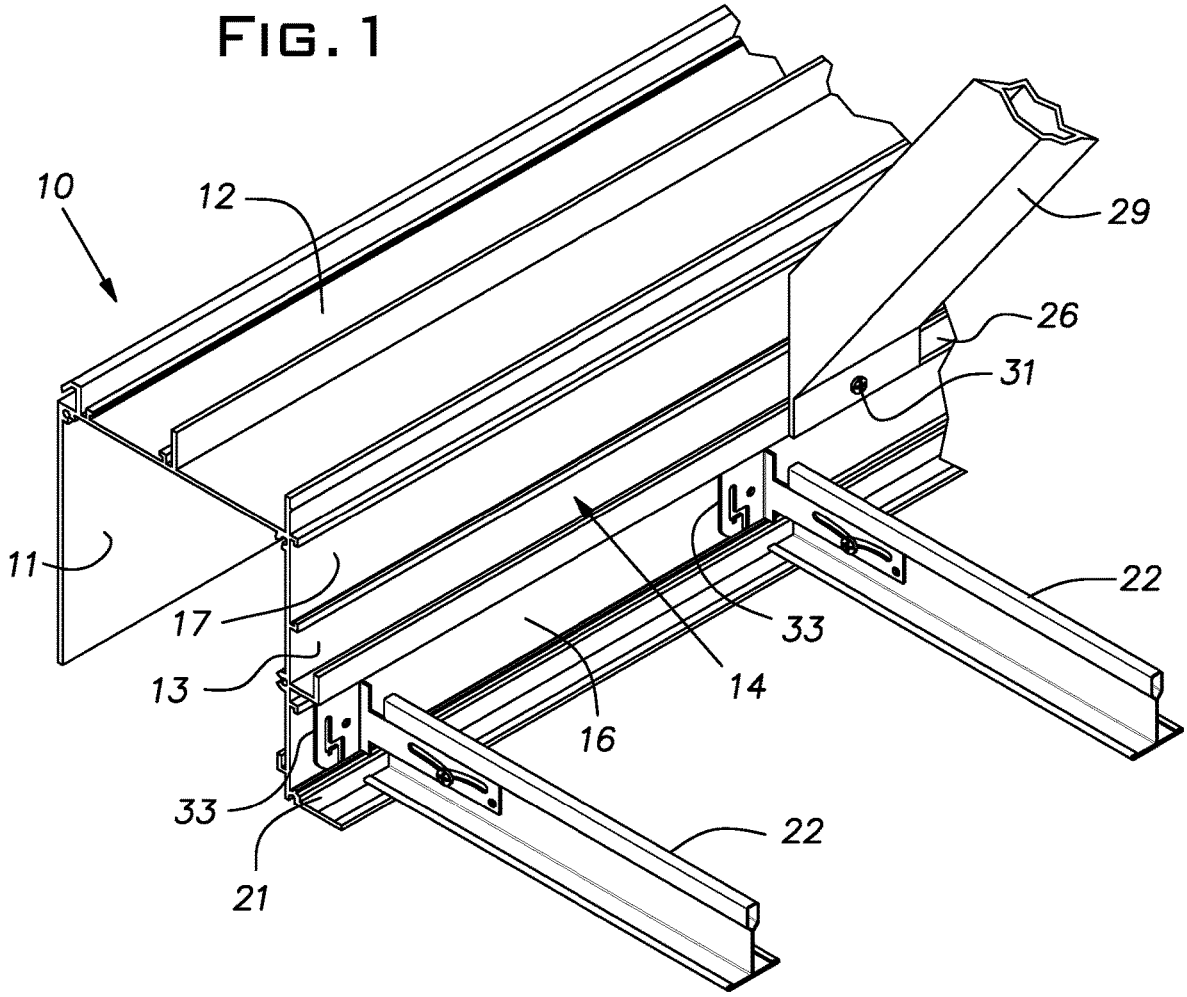
FIG. 1 is a fragmentary isometric view of a perimeter pocket to which connector clips attach associated grid runners or tees.
Figure 2:
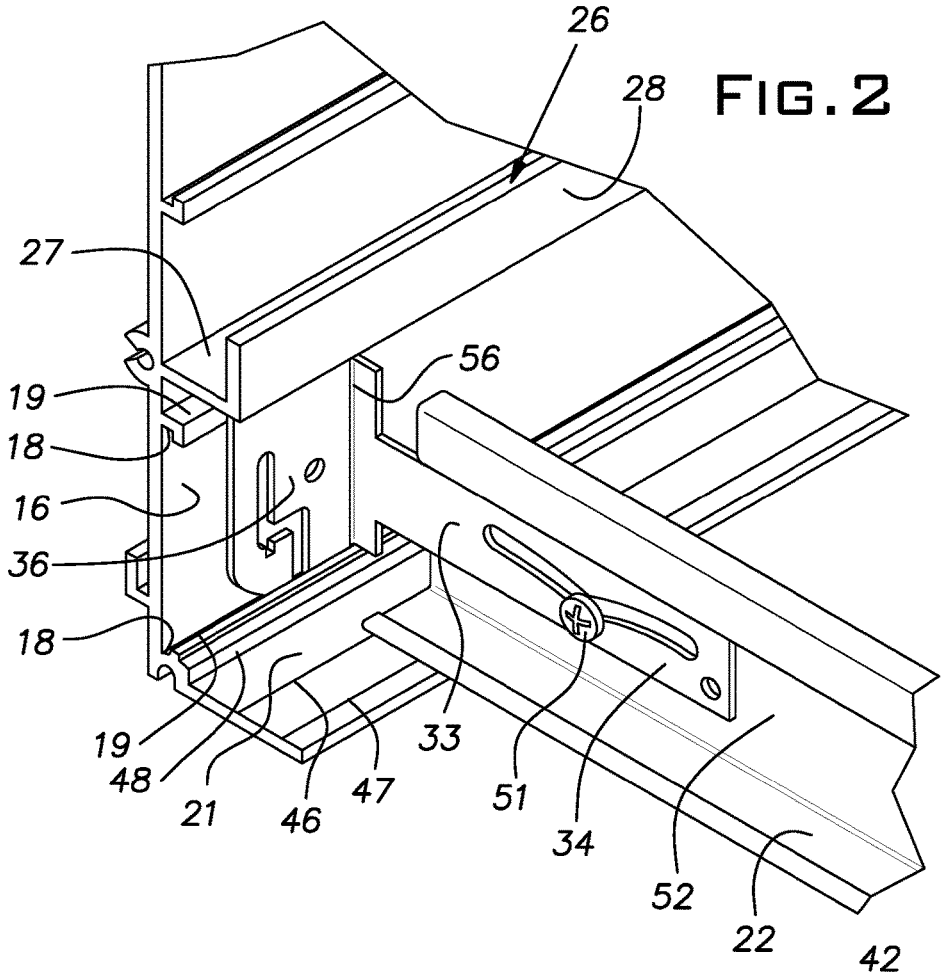
FIG. 2 is an enlarged view of the connector clip joining a grid runner end to the perimeter pocket.

FIG. 1 illustrates a perimeter pocket 10 in the form of an aluminum extrusion. The illustrated pocket 10 has the shape of an inverted generally rectangular channel and can have nominal transverse dimensions of 5 inches by 5 inches by 5 inches, for example. Typically, the pocket or channel 10 can be supplied in 10 foot lengths which are spliced together (or cut) to make a length to suit a particular installation. The illustrated channel of the perimeter pocket 10 is a one piece or monolithic extrusion, but it will be understood that an assembly of separate parts can be substituted.

In normal usage, a vertical outer wall or leg 11 is attached to a wall at the perimeter of an enclosed space or room. A top wall or panel 12 extends horizontally from the outer wall or leg 11 to a vertical inner wall or leg 13.

Figure 3:
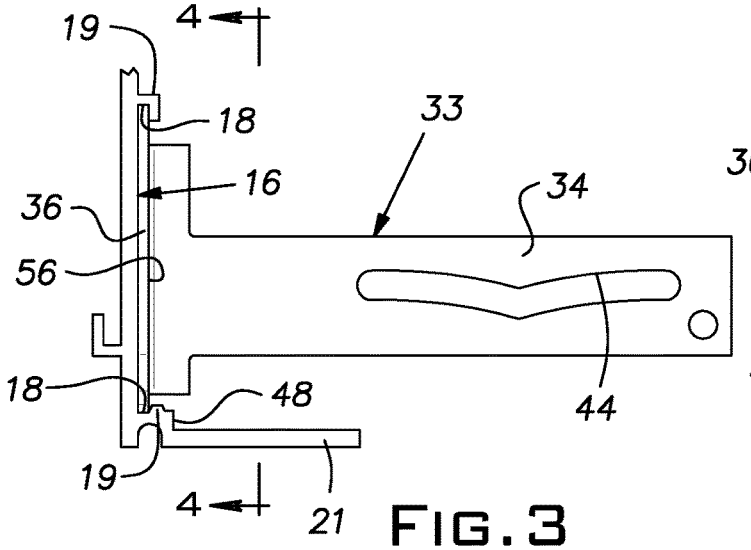
FIG. 3 is an enlarged side view of the connector clip, local area of the perimeter pocket and grid runner end.

The perimeter pocket 10 is installed so that lower edges of the legs 11, 13 are at the intended ceiling height. On an outward face 14, the inner wall 13 has two vertically spaced longitudinally extending channels 16, 17. Referencing FIG. 3, each channel 16, 17 is bounded by opposed narrow slots 18 made by small longitudinally extending right angle projections 19. The lower edge of the inner wall 13 has a longitudinally extending horizontal ledge or flange 21 for supporting ends of grid runners 22 and edges of ceiling panels or tiles (not shown). The width of the ledge 21 is sufficient to satisfy seismic building codes and provides a flat upper surface with a width of about 0.891 inch, for example.

At mid-height, the outward face 14 of the inner leg 13 includes a reinforcing structure extending continuously along the length of the perimeter pocket 10. The reinforcing structure 26, in the illustrated embodiment, has the cross-section of a right angle with a horizontal leg 27 and a vertical leg 28 rising from the horizontal leg. As shown in FIG. 1, the vertical leg 28 can be used for attaching a rigid brace 29 to the inside leg or inner wall 13. The reinforcing leg 28 is penetrated by a screw 31 or other fastener attaching the brace 29, without the fastener penetrating the inner wall 13.

As it will be understood by those skilled in the art, the opposite end of the brace 29 is attached, for instance, to rigid superstructure existing above a suspended ceiling.

Figure 4:
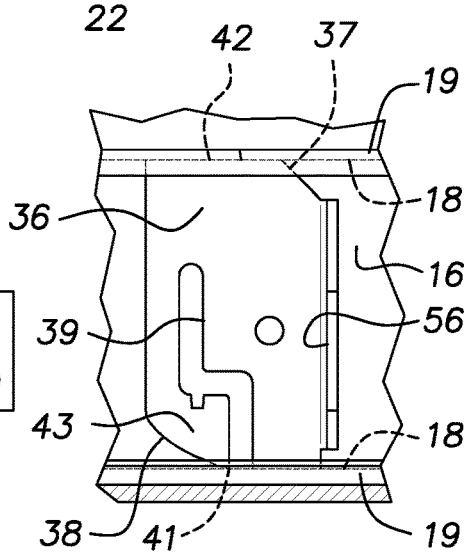
FIG. 4 is a view of a clip and local area of the perimeter pocket and grid runner taken in the plane indicated at 4-4 in FIG. 3.

Connector clips 33, preferably stamped from hot dipped galvanized sheet steel of 18 gauge, for example (0.047 to 0.057 inch), serve to connect ends of grid runners or grid tees 34 to the inner pocket wall 13. The connector clip is similar to the clip disclosed in U.S. Pat. No. 8,820,026. The connector clip 33 is distinguished by a relatively long leg 34 having a through caroming slot 44. The clip 33 when in an installed orientation, has a right angle configuration in plan view. One leg 36 of the clip 33, shown most clearly in FIG. 4, is a planar element proportioned to fit in the lower channel 16 of the inner leg 13. The clip leg 36 preferably has a generally rectangular profile with diagonally opposite corners modified to enable it to be inserted in the lower channel 16. One corner is cut on a straight line edge 37 while the opposed corner has a rounded profile edge 38. A dimension across these corners 37, 38 is less than the space between the entrance to the channel 16 determined by the projections or formations 19. A staggered through slot 39 extends upwardly from a lower edge of the clip leg 36. The slot 39 forms a sharp corner or point 41 on the lower edge of the clip leg 36 at a location in a free state most distant from an upper edge 42 of the clip leg 36 and slightly beyond (lower) than the other parts of the lower clip edge. The geometry of the slot 39 enables a portion 43 of the clip leg 36 to act as a spring to support the point or sharp corner 41 against a confining opposed surface of the bottom slot 18 with a degree of resilience. The other or long leg 34 of the clip 33 is planar and extends perpendicularly from the leg 36. A shallow V-shaped through slot 44 extends along a majority of the length of the leg 34. As it will be understood, the slot 44 serves as a cam for raising or lowering the end of a grid runner or tee 22 in a seismic event.

The clip leg 36 is assembled in the channel 16 at the intended location of a grid runner by first tilting it counterclockwise from the position shown in FIG. 4 so that the leg fits between the projections 19, then pushing it against the outward face 14 of the inner wall 13 and thereafter turning it clockwise until it reaches the position of FIG. 4 where it is trapped in the channel. The clip 33 is proportioned such that the sharp point 41 is resiliently displaced towards the end of the turning movement allowing it to bite into the aluminum body at the base of the slot 18 and lock in position.

With a clip 33 assembled on the pocket leg 13 at a location corresponding to a grid tee location, it is attached to a respective grid tee. Building codes for seismic zones can specify that, at installation, the end of a grid tee or runner be spaced a certain distance from an obstruction. Typically, this dimension can be either ⅜ inch or ¾ inch depending on the seismic zone. FIG. 1 illustrates a feature of the invention that facilitates proper installation of the grid tees. On an upper side of the seismic flange or ledge 21, are longitudinal marks 46, 47 that are in the form of small extruded grooves, for example, that measure distance of, for example, ⅜ inch and ¾ inch from a surface 48 that could represent an obstruction to horizontal movement of the grid tees. Either of the marks 46, 47 or lines can be used by a ceiling installer/technician as a reference for positioning the end of a grid tee relative to the pocket wall 13 thereby facilitating and reducing the time spent in erecting a satisfactory ceiling grid.

The clips 33 are used to connect or tether the ends of grid tees 22 to the perimeter pocket 10. With the end of a grid tee 22 properly positioned on the ledge 21 and abutted against an installed clip 33, a self-drilling sheet metal screw or other fastener 51 is located mid-length in the groove or slot 35 and driven through a web 52 of a grid runner 22.

If a seismic event occurs, a ceiling associated with the perimeter pocket 10 is able to shift horizontally a limited distance with the intent to avoid a collapse. The screw 51 allows horizontal movement of the associated grid tee 22 relative to a clip 33; the slot 44, operating as a cam, causes the screw, operating as a cam follower, to raise the grid tee 22 when it moves from its installed location. When the ceiling shifts away from the perimeter pocket 10, the grid tees 22 are raised so that on a return motion, the tees 22 and ceiling panels (not shown) are above the ledge 21. This assures that the tees 22 do not collide with the ledge 21 and buckle and the ceiling tiles are not knocked off the tees. The inclined cam slot 44, additionally, serves to raise the grid tees 22 where the ceiling moves from its installed position towards the perimeter pocket 10 thereby dampening the ceiling motion.

The integral clip legs or parts 34, 36, intersect at a sharp right angle 56, with an inside radius of about 0.03 inches where the clip is 18 gauge (0.047-0.057 inch material).on a line that extends a majority of the height of the clip leg 36 captured top and bottom within the opposed channel bounding slots 18. This right angle geometry greatly rigidifies the cantilever support of the outwardly extending leg 34 by the captured leg 36. The vertical rigidity of the leg 34 derived from the right angle connection to the captured leg 36 assures that the clip leg has sufficient strength to reliably vertically support the associated grid tee 22 and associated weight of the ceiling tile, particularly where the end of the grid tee has moved completely off the ledge 21 by virtue of movement of the screw 51 in the slot 35.

Figure 5:
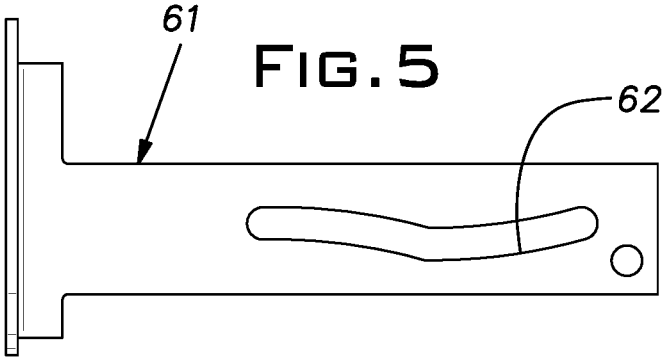
FIG. 5 is a view like FIG. 3 showing a connector clip with an alternative cam slot.

FIG. 5 illustrates a clip 61 with an alternative cam slot 62. Elements of the clip 61 that are the same or equivalent to those of the clip 33 described above are designated with the same numerals. The slot or cam 62 effects vertical movement of the grid tee end in either direction from the installed position towards or away from the pocket 10.

Figure 6:
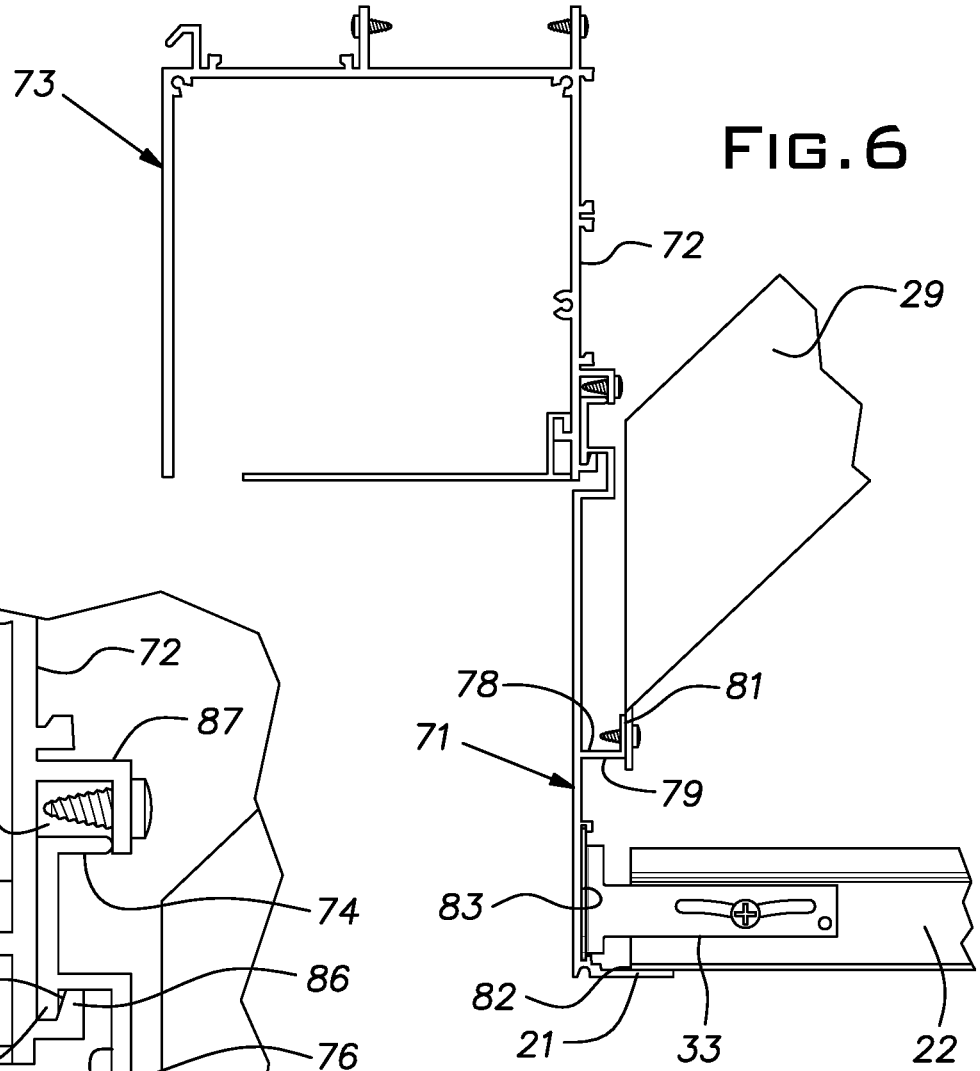
FIG. 6 is a cross-sectional view of an inner wall extension on a perimeter pocket.
Figure 6A:
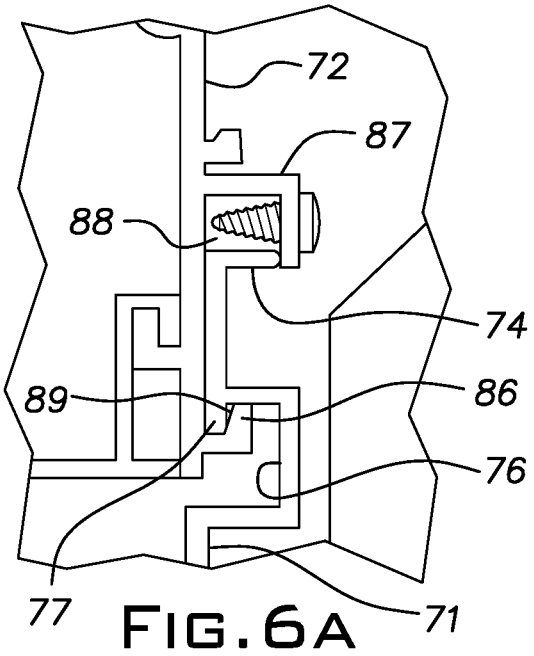
FIG. 6A is an enlarged view of the coupling area of the inner wall extension.

FIG. 6 illustrates a perimeter pocket leg extension 71 depending from a modified inner pocket wall or leg 72 of a perimeter pocket 73 which in other respects is essentially the same as that described for the perimeter pocket 10. The extension 71 can be an extruded aluminum article.

The extension 71 has a generally planar main body structure with several lengthwise formations extending out of the plane of the main body. The extension can be supplied in various widths/heights, for example 4, 6 and 8 inches. An upper edge of the extension 71 as a narrow flange 74 extending in horizontal plane transverse to the plane of the main body of the extension 71. Spaced below and at the same side as the flange 74 is a C-shaped rectangular channel that includes a depending hook 77. At its mid-section, the extension 71 includes a stiffening flange 78 of right angle cross-section comprising a horizontal web 79 and a vertical flange 81 distal from the extension main body. At its lower edge, the extension includes a seismic flange or ledge 82 in form and function like the above-described ledge 21. Additionally, the extension 71 includes a channel 83 identical in form and function to the channel 16 described above for coupling connector clips 33 as described.

The inner wall 72, generally corresponding to the inner pocket wall 13 described above, has a modified lower edge adapted to couple with the upper end of the extension 71. An upstanding hook 86 exists adjacent a lower end of the inner wall 72. Spaced above the hook 86, the leg 72 includes a downwardly extending right angle formation 87. The formation 87 establishes a pocket 88 sized to receive the narrow flange 74 of the extension with negligible clearance. Similarly, the upstanding hook 86 creates a space 89, spaced from the pocket 88 to receive the depending hook 77 with minimal clearance.

The leg extension 71 is assembled on the inner leg 72 of the perimeter pocket 73 by positioning the narrow flange 74 in the pocket 88, while the leg extension 71 is tilted outwardly away from under the pocket 73, raising the tilted leg extension 71 upwardly until the depending hook 77 clears the upstanding hook 86, swinging the leg extension to a vertical orientation, and lowering the depending hook 77 into the space 89. The parts can be dimensioned to provide minimal or zero clearance of the flange 74 in the pocket 88 and hook 77 in the space 89 so that once the leg extension 71 is installed on the perimeter pocket leg 72, it exhibits negligible tendency to swing in pendulum motion relative to the perimeter pocket 73. This positional accuracy facilitates measurements of the associated grid tee lengths and assembly therewith. To supplement the rigidity of the leg extension 71, a brace 91 can be attached with a fastener 92, such as a self-tapping screw driven through the brace and vertical flange 81 of the stiffening flange 78.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In combination, a perimeter pocket having a shape of an inverted generally rectangular channel with a top wall and an inner wall depending vertically from the top wall, an outer face of the inner wall having a longitudinal channel bounded at a top and bottom by opposed slots, a connector clip having first and second legs integral with one another and intersecting at a right angle along a line, said first leg of said legs being trapped in said opposed slots, said second leg of said legs being supported as a cantilever by said first leg, the second leg having an inclined through slot, a grid runner end abutting a side of the second leg, a fastener in said inclined through slot and the grid runner end serving as a cam follower along the inclined through slot to lift said grid runner end, the second leg being the sole support of said grid runner end through said fastener when said grid runner end is horizontally displaced relative to said inner wall, an intersection line of said first and second legs being at least as long as a majority of a distance between said slots whereby said first leg substantially resists sagging of said second leg when supporting the grid runner end.

2. The combination as set forth in claim 1, wherein said first leg is configured with a resiliently biased point formed by a through slot in the first leg and adapted to self-lock the clip longitudinally in said channel.

3. The combination as set forth in claim 1, wherein said inner wall includes an integral stiffening rib spaced horizontally from said opposed slots and configured to be penetrated by a fastener securing a bracket to said stiffening rib while avoiding penetration of said inner wall by said fastener.

* * * * *